US008629380B2

(12) United States Patent
Lafferty

(10) Patent No.: US 8,629,380 B2
(45) Date of Patent: Jan. 14, 2014

(54) SUSCEPTOR WITH CORRUGATED BASE

(75) Inventor: Terrence P. Lafferty, Neenah, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 1278 days.

(21) Appl. No.: 12/234,796

(22) Filed: Sep. 22, 2008

(65) Prior Publication Data

US 2009/0032529 A1 Feb. 5, 2009

Related U.S. Application Data

(63) Continuation-in-part of application No. 12/075,837, filed on Mar. 14, 2008, now abandoned.

(60) Provisional application No. 60/919,745, filed on Mar. 23, 2007, provisional application No. 61/137,571, filed on Jul. 31, 2008.

(51) Int. Cl.
*H05B 6/80* (2006.01)
*A21D 10/02* (2006.01)

(52) U.S. Cl.
USPC ..... 219/730; 219/759; 428/107

(58) Field of Classification Search
USPC ..... 219/725–735, 759, 762; 99/DIG. 14; 426/107, 109, 113, 234, 243, 241; 229/101.1, 242, 128, 903, 938
See application file for complete search history.

(56) References Cited

U.S. PATENT DOCUMENTS 4,036,088 A 7/1977 Ruskin
4,703,148 A 10/1987 Mikulski et al.
4,775,771 A 10/1988 Pawlowski et al.
4,777,053 A 10/1988 Tobelmann et al.
4,865,921 A * 9/1989 Hollenberg et al. ..... 428/461
4,890,439 A 1/1990 Smart
4,936,935 A 6/1990 Beckett
4,963,424 A 10/1990 Beckett
5,041,295 A 8/1991 Perry et al.
5,053,594 A 10/1991 Thota et al.
5,093,364 A 3/1992 Richards et al.
5,117,078 A 5/1992 Beckett
5,170,025 A 12/1992 Perry
5,213,902 A 5/1993 Beckett
5,221,419 A 6/1993 Beckett (Continued)

FOREIGN PATENT DOCUMENTS

EP 0 943 558 A2 9/1999
EP 1 132 317 A1 9/2001

(Continued)

OTHER PUBLICATIONS

Notification of Reason for Refusal for JP 2008-558373 dated Aug. 10, 2011 with English translation.

(Continued)

*Primary Examiner* — Quang Van
(74) *Attorney, Agent, or Firm* — Womble Carlyle Sandridge & Rice, LLP

(57) ABSTRACT

A thermally insulated susceptor structure includes a dimensionally stable corrugated base, a first susceptor, and a second susceptor. At least one of the first susceptor and second susceptor may circumscribe one or more microwave energy transparent areas that allow the transmission of microwave energy through the respective susceptor and/or create localized fields that enhance heating, browning and/or crisping of an adjacent food item.

34 Claims, 7 Drawing Sheets

(56) References Cited

U.S. PATENT DOCUMENTS

| | | | |
|---|---|---|---|
| 5,260,537 | A | 11/1993 | Beckett |
| 5,266,386 | A | 11/1993 | Beckett |
| 5,310,977 | A | 5/1994 | Stenkamp et al. |
| 5,317,120 | A | 5/1994 | Bunke et al. |
| RE34,683 | E | 8/1994 | Maynard et al. |
| 5,334,820 | A | 8/1994 | Risch et al. |
| 5,340,436 | A | 8/1994 | Beckett |
| 5,354,973 | A | 10/1994 | Beckett |
| 5,410,135 | A | 4/1995 | Pollart et al. |
| 5,424,517 | A | 6/1995 | Habeger et al. |
| 5,519,195 | A | 5/1996 | Keefer et al. |
| 5,527,413 | A | 6/1996 | Perry et al. |
| 5,585,027 | A | 12/1996 | Young |
| 5,628,921 | A | 5/1997 | Beckett |
| 5,672,407 | A | 9/1997 | Beckett |
| 5,759,422 | A | 6/1998 | Schmelzer et al. |
| 5,800,724 | A | 9/1998 | Habeger et al. |
| 6,114,679 | A | 9/2000 | Lai et al. |
| 6,137,099 | A | 10/2000 | Hamblin |
| 6,150,646 | A | 11/2000 | Lai et al. |
| 6,204,492 | B1 | 3/2001 | Zeng et al. |
| 6,251,451 | B1 | 6/2001 | Zeng |
| 6,414,290 | B1 | 7/2002 | Cole et al. |
| 6,433,322 | B2 | 8/2002 | Zeng et al. |
| 6,455,827 | B2 | 9/2002 | Zeng |
| 6,552,315 | B2 | 4/2003 | Zeng et al. |
| 6,677,563 | B2 | 1/2004 | Lai |
| 6,717,121 | B2 | 4/2004 | Zeng et al. |
| 6,765,182 | B2 | 7/2004 | Cole et al. |
| 2001/0032843 | A1 | 10/2001 | Aronsson et al. |
| 2003/0080119 | A1 | 5/2003 | Chisholm et al. |
| 2004/0023000 | A1 | 2/2004 | Young et al. |
| 2006/0049190 | A1 | 3/2006 | Middleton et al. |
| 2006/0157480 | A1 | 7/2006 | Lafferty |
| 2007/0221666 | A1 | 9/2007 | Keefe et al. |
| 2007/0251943 | A1 | 11/2007 | Wnek et al. |
| 2008/0230537 | A1 | 9/2008 | Lafferty |

FOREIGN PATENT DOCUMENTS

| | | | |
|---|---|---|---|
| EP | 1188688 | A1 * | 3/2002 |
| JP | S63-086076 | | 6/1988 |
| JP | S64-56680 | | 4/1989 |
| JP | 1-82176 | | 6/1989 |
| JP | H01-082176 | | 6/1989 |
| JP | S62-178232 | | 6/1989 |
| JP | 2000-30854 | | 1/2000 |
| JP | 2001-292689 | | 10/2001 |
| JP | 2002-186470 | | 7/2002 |
| WO | WO 91/09791 | | 7/1991 |
| WO | WO 98/08752 | | 3/1998 |
| WO | WO 01/22778 | A1 | 3/2001 |
| WO | WO 2004/013015 | A1 | 2/2004 |
| WO | WO 2007/103428 | A2 | 9/2007 |
| WO | WO 2007/133659 | A2 | 11/2007 |
| WO | WO 2009/114038 | A1 | 9/2009 |

OTHER PUBLICATIONS

Notification of Reason for Refusal for JP 2010-550660 dated Aug. 21, 2012 with English translation.

PCT/US2007/005818—International Search Report and Written Opinion, Oct. 12, 2007, Graphic Packaging International, Inc.

PCT/US2007/005818—International Preliminary Report on Patentability, Sep. 9, 2008, Graphic Packaging International, Inc.

PCT/US2008/077168—International Preliminary Report on Patentability, Sep. 23, 2010, Graphic Packaging International, Inc.

Notification of Reason for Refusal for JP 2010-550660 dated Jun. 27, 2013 with English translation.

US 6,177,664, 01/2001, Cole et al. (withdrawn)

* cited by examiner

SUSCEPTOR WITH CORRUGATED BASE

CROSS-REFERENCE TO RELATED APPLICATIONS

This application is a continuation-in-part of U.S. patent application Ser. No. 12/075,837, filed Mar. 14, 2008, which claims the benefit of U.S. Provisional Application No. 60/919,745, filed Mar. 23, 2007, and this application claims the benefit of U.S. Provisional Application No. 61/137,571, filed Jul. 31, 2008. All of the above-referenced applications are incorporated by reference herein in their entirety.

TECHNICAL FIELD

The present disclosure relates to materials, packages, constructs, and systems for heating, browning, and/or crisping a food item in a microwave oven.

BACKGROUND

Microwave ovens provide a convenient means for heating a variety of food items, including sandwiches and other bread and/or dough-based products such as pizzas and pies. However, microwave ovens tend to cook such items unevenly and are unable to achieve the desired balance of thorough heating and a browned, crisp crust. As such, there is a continuing need for improved materials, packages, and other constructs that provide the desired degree of heating, browning, and/or crisping of various food items in a microwave oven.

SUMMARY

The present disclosure relates generally to various microwave energy interactive structures that may be used to form sleeves, disks, trays, cartons, packages, and other constructs (collectively "constructs") for improving the heating, browning, and/or crisping of a food item in a microwave oven. The various structures generally comprise a plurality of components or layers assembled and/or joined to one another in a facing, substantially contacting, layered configuration. The layers include at least two microwave energy interactive elements and a dimensionally stable base. Each microwave energy interactive element comprises one or more microwave energy interactive components or segments arranged in a particular configuration to absorb microwave energy, transmit microwave energy, reflect microwave energy, or direct microwave energy, as needed or desired for a particular microwave heating application. In one example, each of the microwave energy interactive elements comprises a susceptor. The susceptor may circumscribe one or more microwave energy transparent areas that allow the passage of microwave energy though the respective susceptor layer.

The base generally may provide thermal insulation between the microwave energy interactive element and the heating environment. In one example, the base comprises a corrugated paper or paperboard and the structure is a thermally insulated susceptor structure.

It has been found that the use of more than one susceptor with an insulating base to form a thermally insulated susceptor structure significantly enhances the heating, browning, and crisping of a food item thereon as compared with either (1) a structure including more than one susceptor layer without a thermal insulating base, or (2) a single susceptor overlying a thermal insulating base. If needed or desired, at least one aperture or cutout may extend through one or more layers of the structure to provide direct heating and/or ventilation to the bottom surface of the food item.

Thus, in one example, a thermally insulated susceptor structure comprises a dimensionally stable base having a first side and a second side opposite the first side, a first susceptor disposed on the first side of the base, and a second susceptor disposed on the second side of the base. The base may include a plurality of corrugations. The first susceptor, second susceptor, or both the first and second susceptor may circumscribe at least one microwave energy transparent area.

In another example, a thermally insulated susceptor structure comprises a dimensionally stable corrugated base having a first side and a second side opposite the first side, a first susceptor overlying the first side of the base, and a second susceptor overlying the first susceptor. At least one of the first susceptor and the second susceptor may circumscribe at least one microwave energy transparent area. The first susceptor may overlie the base in a substantially planar configuration across the corrugations, thereby forming a plurality of insulating voids adjacent to the corrugations on the first side of the base.

In each of various independent examples, the first susceptor and/or second susceptor may be supported on a polymer film layer and/or may be joined to a respective support layer, for example, paper. The various layers may be arranged in numerous ways in the susceptor structure. The structure also may include one or more additional layers, for example, paper layers, polymer film layers, susceptor layers, and/or corrugated layers.

Any of such structures may be used to form a construct for heating, browning, and/or crisping a food item in a microwave oven. In one example, a microwave heating construct comprises a dimensionally stable corrugated base, a first susceptor layer, and a second susceptor layer. At least one of the first susceptor layer and the second susceptor layer may include a central region including at least one microwave energy transparent area circumscribed by the respective susceptor layer, and at least one of the first susceptor layer and the second susceptor layer may include a peripheral region including at least one microwave energy transparent area circumscribed by the respective susceptor layer.

One or both susceptor layers may include the various microwave energy transparent areas, such that the first susceptor layer may include both the central region and peripheral region, the second susceptor layer may include both the central region and peripheral region, both the first and second susceptor layers may each include a respective central region and peripheral region, or one susceptor layer may contain one region, while the other susceptor layer may include the other region.

In one particular example, the microwave energy transparent areas in the central region are substantially circular in shape, with a greater number of microwave energy transparent areas proximate a center of the construct, and the microwave energy transparent areas in the peripheral region are substantially square in shape. However, numerous other arrangements of microwave energy interactive areas are contemplated.

Various other aspects, features, and advantages of the invention will become apparent from the following description and accompanying figures. Although several different aspects, implementations, and embodiments of the invention are provided, numerous interrelationships, combinations, and modifications of the various aspects, implementations, and embodiments of the invention are contemplated.

BRIEF DESCRIPTION OF THE DRAWINGS

The description refers to the accompanying drawings in which like reference characters refer to like parts throughout the several views, and in which.

DESCRIPTION

Figure 1:
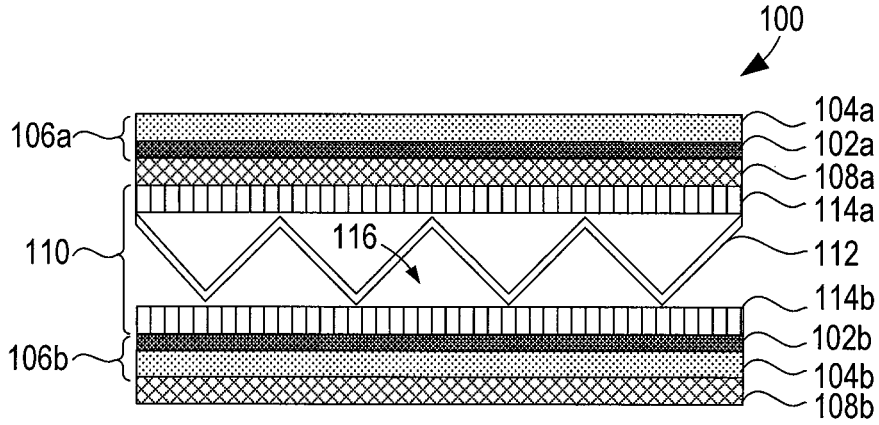
FIGS. 1-11 are schematic cross-sectional views of various exemplary microwave energy interactive structures.

The present disclosure relates generally to various microwave energy interactive structures that may be used to form microwave heating packages or other constructs that improve the heating, browning, and/or crisping of a food item in a microwave oven. Each of the various structures includes a pair of microwave energy interactive elements overlying at least a portion of a dimensionally stable (e.g., rigid or semi-rigid) base.

One or both of the microwave energy interactive elements may comprise a thin layer of microwave energy interactive material (i.e., a "susceptor") (generally less than about 100 angstroms in thickness, for example, from about 60 to about 100 angstroms in thickness) that tends to absorb at least a portion of impinging microwave energy and convert it to thermal energy (i.e., heat) at an interface with a food item. The susceptor may be supported on a microwave energy transparent substrate, for example, a layer of paper or polymer film for ease of handling and/or to prevent contact between the microwave energy interactive material and the food item. Susceptor elements often are used to promote browning and/or crisping of the surface of a food item. However, other microwave energy interactive elements may be used.

The base generally may provide thermal insulation between the microwave energy interactive element and the heating environment. In one example, the base comprises a fluted or corrugated paper or paperboard. However, other materials that provide an insulating space or void that can reduce undesirable heat transfer away from the microwave energy interactive element may be used. It will be appreciated that numerous structures having different configurations may be formed with such materials, and that such structures are contemplated.

It has been discovered that a construct formed from a structure including more than one susceptor layer and a layer of corrugated insulating material significantly enhances the heating, browning, and/or crisping of a food item as compared with either (1) a structure including more than one susceptor layer without a corrugated base, or (2) a single susceptor overlying a corrugated base. When the construct is exposed to microwave energy, the susceptor layers convert at least a portion of the impinging microwave energy to thermal energy, which then heats the adjacent food item, and in some cases, the air within the flutes and/or the other susceptor layer(s). As a result, the heating, browning, and/or crisping of the food item may be enhanced significantly. Additionally, while not wishing to be bound by theory, it is believed that the air and other gases between the flutes of the corrugated base provide insulation between the food item and the ambient environment of the microwave oven, thereby increasing the amount of sensible heat that stays within or is transferred to the food item. Some structures also may include apertures that allow moisture to be vented away from the food item, thereby further enhancing browning and/or crisping of the food item.

Various aspects of the invention may be illustrated by referring to the figures, in which several exemplary constructs are depicted schematically. For simplicity, like numerals may be used to describe like features. It will be understood that where a plurality of similar features are depicted, not all of such features necessarily are labeled on each figure. While various exemplary embodiments are shown and described in detail herein, it also will be understood that any of the features may be used in any combination, and that such combinations are contemplated by the invention.

FIG. 1 depicts a schematic cross-sectional view of an exemplary microwave energy interactive structure 100. The structure 100 includes a pair of microwave energy interactive elements 102*a*, 102*b*, for example, susceptors, supported on respective microwave energy transparent substrates 104*a*, 104*b*, for example, polymer film layers, to collectively define respective susceptor films or susceptor film layers 106*a*, 106*b*. Each susceptor film 106*a*, 106*b* is joined respectively to a microwave energy transparent, dimensionally stable support or support layer 108*a*, 108*b*, for example, paper. The support layers 108*a*, 108*b* are joined to opposite sides of a dimensionally stable corrugated base 110.

In this example, the base 110 is a double faced corrugated material comprising a plurality of flutes 112 bound on opposed surfaces by a pair of substantially planar facing layers 114*a*, 114*b*, thereby defining a plurality of insulating voids or spaces 116 between the flutes 112 and the facing layers 114*a*, 114*b*. It is noted that in the various figures, the flutes or corrugations of the insulating base are shown as having a more angular, sawtooth shape. However, it will be understood that such figures are schematic only, and that the various flutes may have a more rounded, sinusoidal shape.

Not all of such layers may be necessary for a particular microwave heating application. Furthermore, in some cases, the layers of the structure may be rearranged without adversely affecting the heating, browning, and/or crisping capabilities of the structure. For example, FIGS. 2-6 schematically depict several exemplary variations of the microwave energy interactive structure 100 of FIG. 1, each of which includes two susceptor layers and an insulating base. The various structures 200, 300, 400, 500, 600 include features that are similar to structure 100 shown in FIG. 1, except for variations noted and variations that will be understood by those of skill in the art. For simplicity, the reference numerals of similar features are preceded in the figures with a "2" (FIG. 2), "3" (FIG. 3), "4" (FIG. 4), "5" (FIG. 5), or "6" (FIG. 6) instead of a "1".

Figure 2:
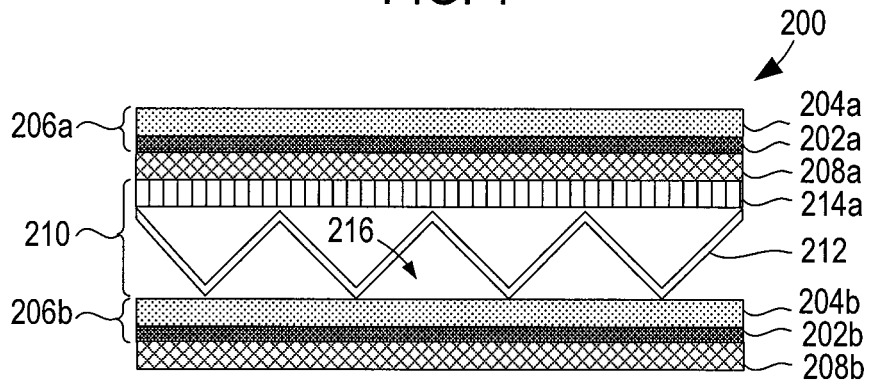

By way of example, FIG. 2 illustrates an exemplary microwave energy interactive structure 200 that is similar to the structure 100 of FIG. 1, except that structure 200 of FIG. 2 includes a single faced corrugated base 210 comprising a substantially planar facing or layer (or "flat side") 214*a* and a corrugated or fluted structure or layer ("fluted side") 212 opposite the flat side 214*a*. Susceptor film 206*b* and support 208*b* are joined to the flutes in a substantially planar configuration, such that susceptor film 206*b* and support 208*b* extend across and are at least partially joined to the outermost points of the flutes (i.e., across and along the spines of the flutes). Insulating voids 216 lie between substrate 204*b* and the corrugations 212.

Figure 3:
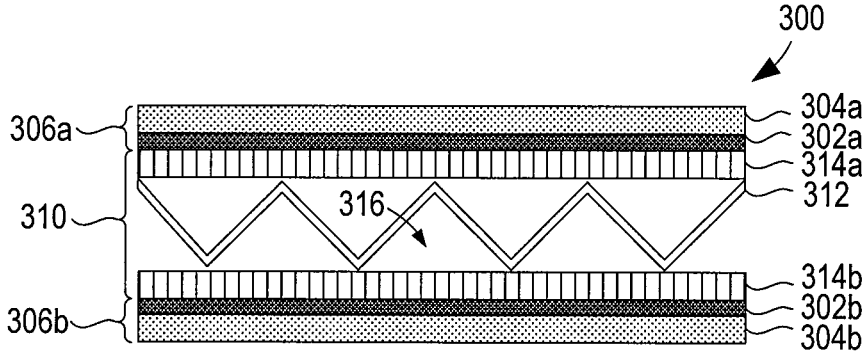
Figure 4:
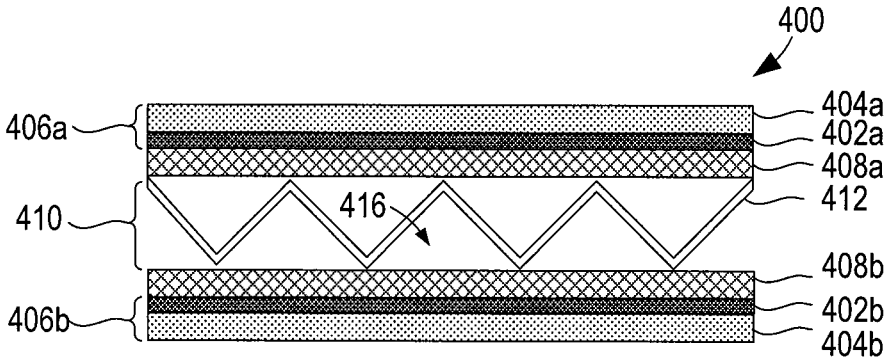

FIG. 3 illustrates an exemplary structure 300 without the support layers 108*a*, 108*b* of FIG. 1. In this example, susceptor films 306*a*, 306*b* are joined directly to the facing layers 314*a*, 314*b* of the corrugated base 310. Conversely, FIG. 4 illustrates an exemplary structure 400 with an unfaced corrugated base 410. In this example, the flutes 412 are joined directly to support layers 408*a*, 408*b*, thereby defining insulating voids 416. It is noted that the relative positions of the susceptor film 406*b* and support 408*b* are inverted relative to susceptor film 106*b* and support 108*b* of FIG. 1. This may simplify construction, for example, where the corrugated structure 412 and support 408*b* are each formed from paper and such layers are being joined together adhesively. However, it is contemplated that the layers may be configured with the support 408*b* on the outside of the structure 400. It also is noted that, since layers 314*a*, 314 and layers 408*a*, 408*b* may be formed from similar materials (e.g. paper), the structures of FIGS. 3 and 4 ma y be similar in form and/or function. Nonetheless, both structures 300, 400 are illustrated schematically herein for clarity and completeness. The particular construction selected for a given application may depend on the available materials, the capabilities of the process and/or machinery used to form the structure, and/or numerous other factors.

If desired, any of the various structures may include one or more apertures or cutouts extending through all or a portion of one or more layers. Such apertures may have any shape and/or configuration and may be used for various purposes, as will be discussed further below.

Figure 5:
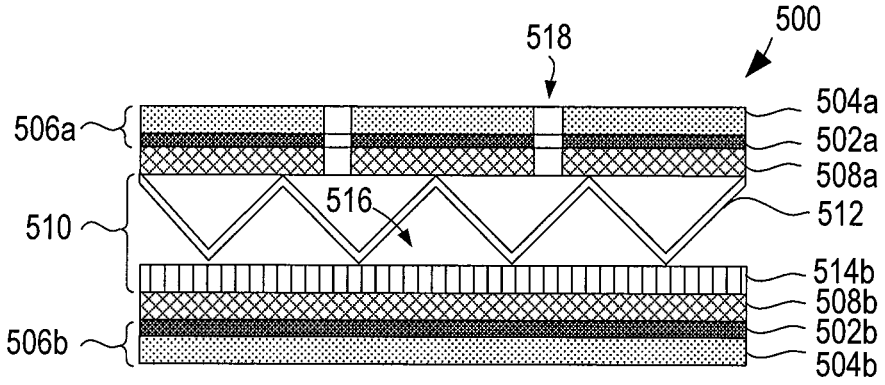

For example, the structure 500 of FIG. 5 is similar to the structure 400 of FIG. 4, except that the corrugated base 510 has a single facing layer 514*b*. A plurality of apertures or slits 518 extend through the first susceptor film 506*a* and support 508*a*, thereby exposing the corrugations or flutes 512 and insulating voids 516. If desired, the support layer 504*a* may serve as a food contacting layer or surface in open communication with the insulating voids 516 through apertures 518. In such examples, moisture generated by the food item may pass through apertures 518 into the voids 516, which may serve as venting channels that carry the moisture away from the food item to enhance browning and/or crisping of the food item further.

Figure 6:
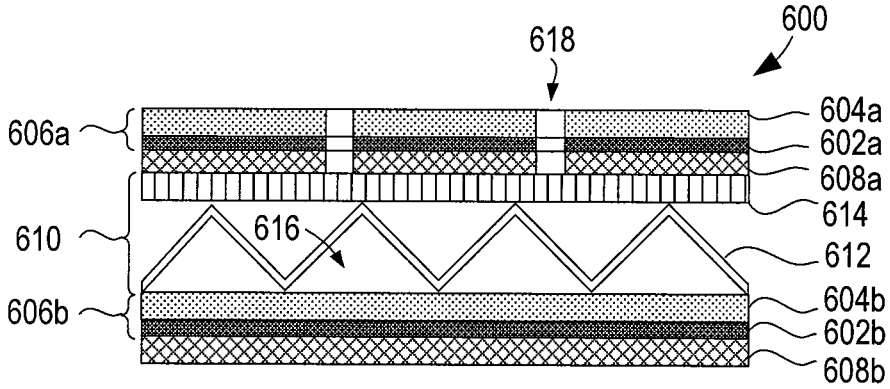

FIG. 6 schematically depicts another microwave energy interactive structure 600. In this example, the structure 600 is similar to the structure 200 of FIG. 2, except that the structure 600 of FIG. 6 includes a plurality of apertures or slits 618 extending through the first susceptor film 606*a* and support 608*a*, thereby exposing the facing 614 of base 610. In this example, the apertures 618 may provide browning marks that create the impression of heating on a griddle or grill and also may provide some drawing of moisture away from the food item.

Figure 7:
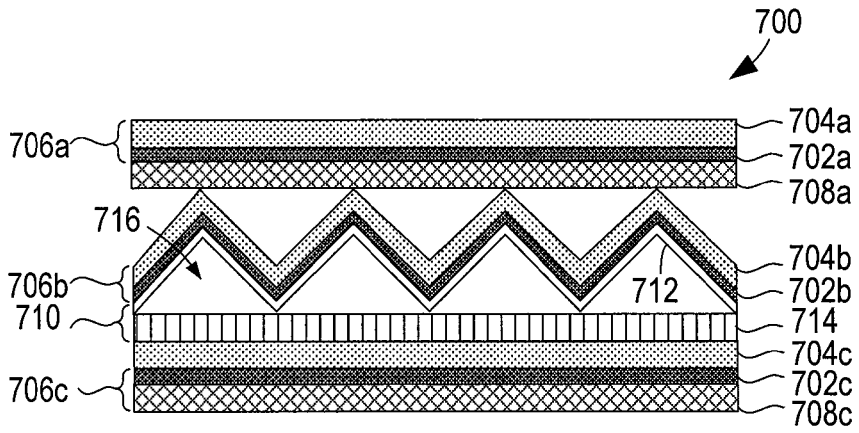

In some examples, the structure may include one or more susceptor layers, susceptor film layers, and/or support layers that directly overlie the faces of the flutes or corrugations in a substantially contacting relationship, such that the particular susceptor layer, susceptor film layer, and/or support layer also is corrugated or fluted. For example, FIG. 7, schematically depicts an exemplary microwave energy interactive structure 700 including a first susceptor film 706*a* joined to a first support layer 708*a*, a second susceptor film 706*b* overlying the fluted or corrugated side of a single faced corrugated base 710, and a third susceptor film 706*c* joined to a second support layer 708*c*. The susceptor films 706*a*, 706*b*, 706*c* each comprise a respective layer of microwave energy interactive material 702*a*, 702*b*, 702*c* supported on a respective substrate 704*a*, 704*b*, 704*c*. The base 710 comprises a facing layer 714 and a plurality of flutes 712. The second susceptor film 706*b* is corrugated and overlies flutes 712. Insulating voids 716 lie between support layer 708*a* and flutes 712 and between facing layer 714 and flutes 712.

FIGS. 8-12 schematically depict some exemplary variations of the microwave energy interactive structure 700 of FIG. 7. The various structures 800, 900, 1000, 1100, 1200 include features that are similar to structure 700 shown in FIG. 7, except for variations noted and variations that will be understood by those of skill in the art. For simplicity, the reference numerals of similar features are preceded in the figures with an "8" (FIG. 8), "9" (FIGS. 9A and 9B), "10" (FIG. 10), or "11" (FIG. 11) instead of a "7".

Figure 8:
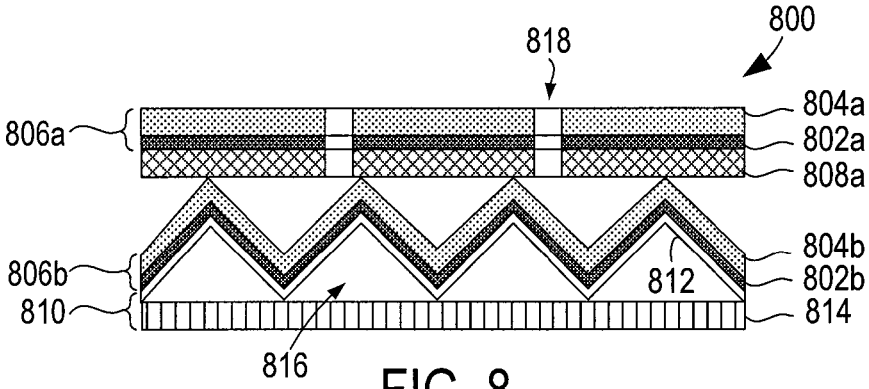

The structure 800 of FIG. 8 is similar to the structure 700 of FIG. 7, except that the structure 800 of FIG. 8 does not include a third susceptor film 706*c* and support 708*c*. Additionally, in this example, a plurality of apertures or slits 818 extend through the first susceptor film 806*a* and support 808*a*, such that apertures 818 are in open communication with voids 816 and the second susceptor film 806*b* overlying the base 810. In some instances, the voids 816 may serve as venting channels to enhance browning and/or crisping of a food item.

Figure 9A:
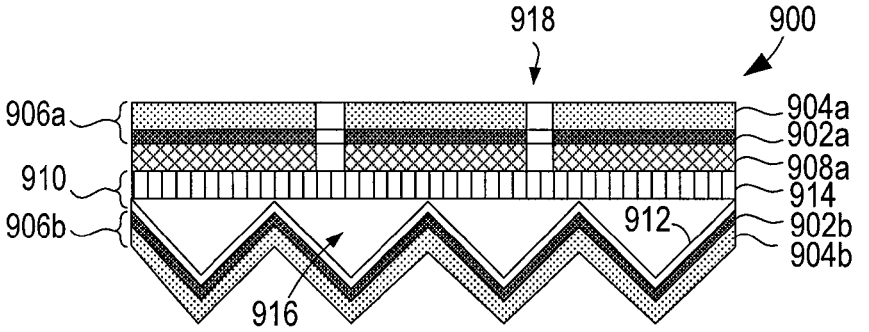
Figure 9B:
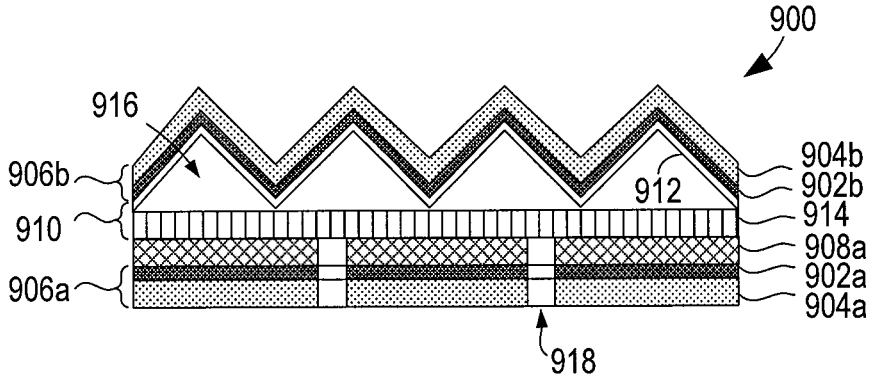

The structure 900 of FIG. 9A is similar to the structure 800 of FIG. 8, except that susceptor layer 806*b* and the corrugated base 810 are inverted, such that the facing layer 914 is joined to the first support layer 908*a* In this configuration, the substrate layer 904*a* may comprise a food-contacting surface. With the structure 900 inverted, as shown in FIG. 9B, substrate 904*b* may comprise a food contacting surface. In this latter configuration, the apertures 918 lie on the bottom side of the structure 900 adjacent to the floor of the microwave oven. The apertures 918 may provide a thermal insulating benefit and/or may improve air circulation around the structure 900.

Figure 10:
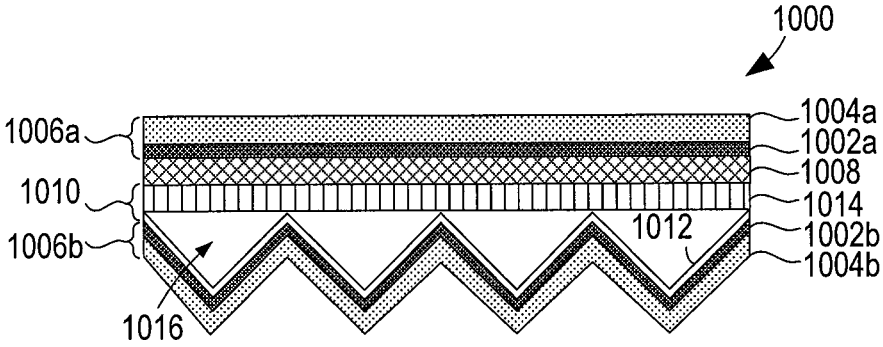
Figure 11:
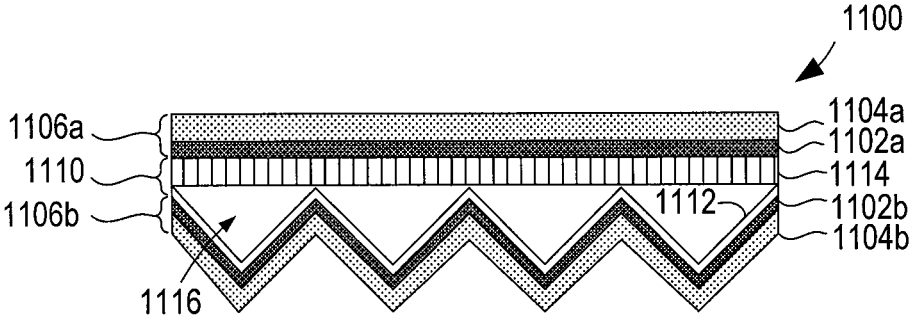
Figure 12:
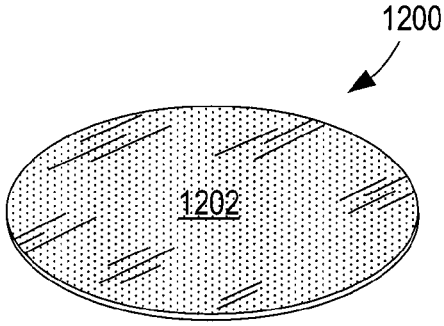
FIG. 12 is a schematic perspective view of a microwave energy interactive heating disk that may be formed from a microwave energy interactive structure.

FIG. 10 schematically illustrates still another exemplary microwave energy interactive structure 1000. The structure 1000 is similar to the structure 900 of FIG. 9A, without apertures 918. FIG. 11 is similar to the structure 1000 of FIG. 10A without the support layer 1008*a*.

Figure 13:
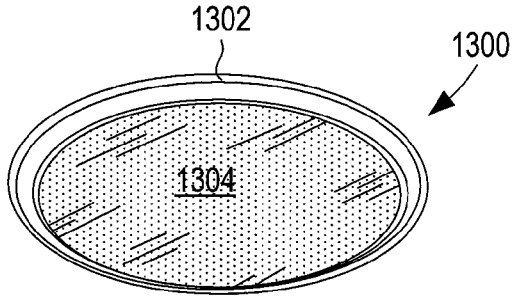
FIG. 13 is a schematic perspective view of a microwave energy interactive heating tray that may be formed from a microwave energy interactive structure.

The various structures shown herein and/or contemplated hereby may be used to form numerous constructs for heating, browning, and/or crisping a food item in a microwave oven. For example, FIG. 1200 depicts an exemplary microwave energy interactive construct 1200 (e.g., a disk) having a substantially circular heating surface 1202 (shown schematically by stippling FIGS. 12 and 13) suitable for heating, for example, a pizza, panini, or other circular food item thereon. If desired, the edges of the disk 1200 may be upturned to form a tray 1300 having an upturned peripheral area or sidewall 1302 surrounding a heating surface 1304, as shown schematically in FIG. 13. Such a tray 1300 (and numerous others) may be formed, for example, using conventional thermal and/or mechanical press forming equipment. However, the various microwave energy interactive structures may be used to form all or a portion of any type of construct, for example, a package, carton, disk, sleeve, pouch, platform, and so forth.

Any of such constructs may have any suitable shape, for example, square, rectangular, triangular, oval, or any other regular or irregular shape.

Countless other microwave energy interactive structures and constructs are contemplated by the disclosure. As stated previously, any of such structures may include one or more areas that are transparent to microwave energy. Such microwave energy transparent areas transmit microwave energy and, in some instances, may cause the formation of localized electric fields that enhance heating, browning, and/or crisping of an adjacent food item. The transparent areas may be sized, positioned, and/or arranged to customize the heating, browning, and/or crisping of a particular area of the food item to be heated.

Figure 14A:
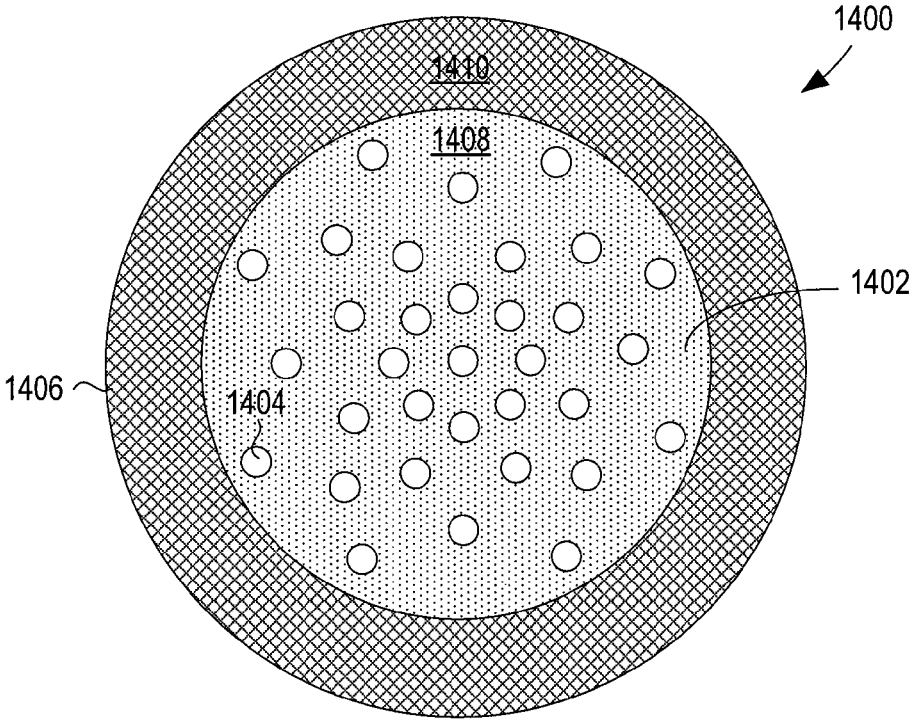
FIG. 14A is a schematic top plan view of an exemplary microwave heating construct including microwave energy transparent areas.

For example, FIG. 14A schematically illustrates a top plan view of a microwave heating construct 1400 (e.g., a microwave heating disk) that generally includes a susceptor 1402 (shown with stippling) that circumscribes a plurality of microwave energy transparent areas 1404, 1406 (shown in white). In this example, the disk 1400 has a substantially circular shape. However, any regular or irregular shape may be used.

The disk 1400 includes a central region 1408 and a peripheral region 1410. In the central region 1408 of the disk 1400, the transparent areas 1404 are substantially circular in shape, with the concentration of microwave energy transparent areas 1404 decreasing from the center of the disk 1400 outwardly towards the peripheral region 1410. However, other configurations are contemplated. In the peripheral region 1410, the microwave energy transparent areas 1406 are substantially square in shape and arranged in rows and columns, such that the microwave energy interactive material in the peripheral area has a grid-like appearance. As stated above, the percent transparent area may be varied as needed to achieve the desired heating, browning, and/or crisping of the food item. Such areas may be formed in any suitable manner, as will be described below.

Figure 14B:
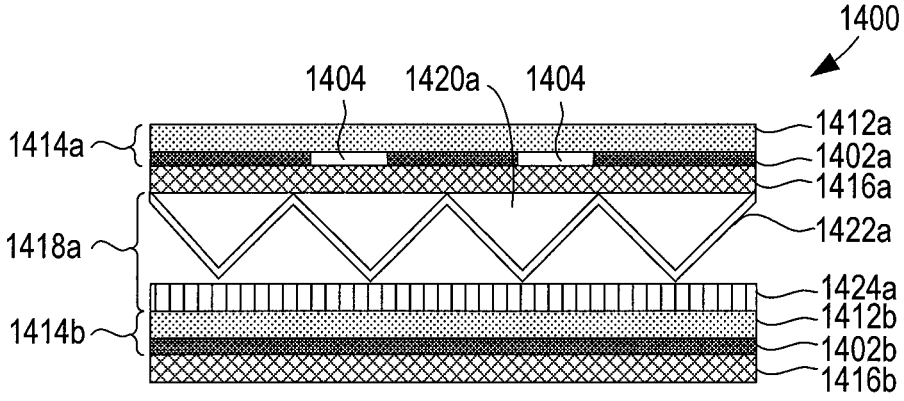
FIG. 14B is a schematic cross-sectional view of a portion of the construct of FIG. 14A.

FIG. 14B schematically illustrates a cross-sectional view of a portion of the microwave heating disk 1400 of FIG. 14A. The microwave heating disk 1400 includes a pair of microwave energy interactive elements 1402*a*, 1402*b*, for example, susceptors, supported on respective microwave energy transparent substrates 1412*a*, 1412*b*, for example, polymer film layers, to collectively define respective susceptor films or susceptor film layers 1414*a*, 1414*b*. Each susceptor film 1414*a*, 1414*b* is joined respectively to a microwave energy transparent, dimensionally stable support or support layer 1416*a*, 1416*b*, for example, paper. Support layer 1416*a* is joined to the fluted side of a single faced corrugated material 1418*a*, thereby defining a plurality of insulating voids or spaces 1420*a* between the flutes 1422*a* and the support layer 1416*a*, while substrate layer 1412*b* is joined to the facing 1424*a* of the corrugated material 1418*a*. Susceptor 1402*a* circumscribes at least one, and in some examples, a plurality, of microwave energy transparent (i.e., inactive) areas 1404 (or 1406, FIG. 14A).

Figure 15:
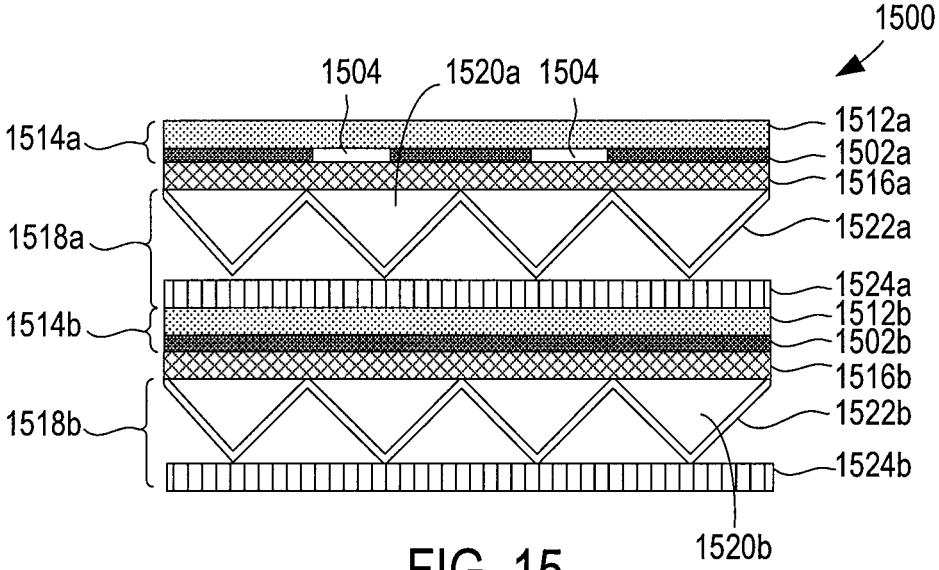
FIGS. 15 and 16 are schematic cross-sectional views of alternate microwave constructs, which optionally include the arrangement of microwave energy transparent areas of FIG. 14A.
Figure 16:
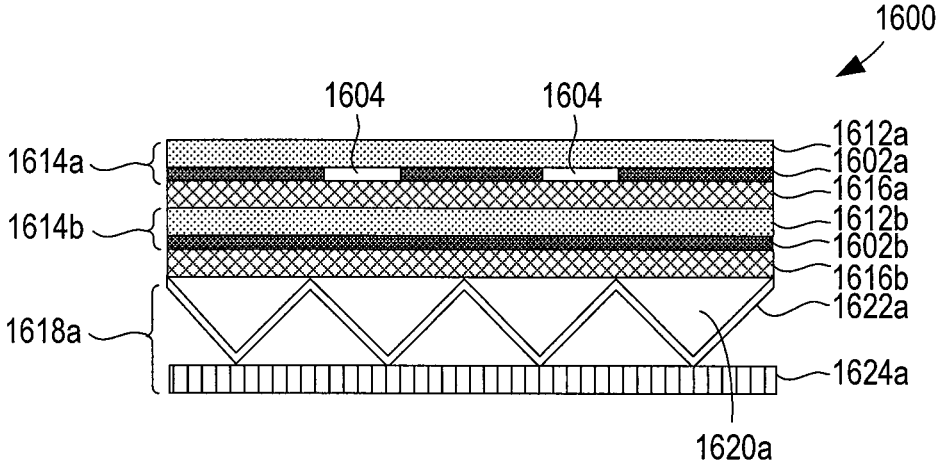

FIGS. 15 and 16 schematically depict exemplary variations of the microwave energy interactive disk 1400 of FIGS. 14A and 14B. The microwave heating disks 1500, 1600 may include features that are similar to the disk 1400 shown in FIGS. 14A and 14B, except for variations noted and variations that will be understood by those of skill in the art. For simplicity, the reference numerals of similar features are preceded in the figures with a "15" (FIG. 15) or "16" (FIG. 16).

In the example shown in FIG. 15, the microwave heating disk 1500 includes an additional layer of corrugated material 1518*b*, with the flutes 1522*b* being joined to support layer 1516*b* to define additional insulating voids 1520*b* adjacent to the flutes 1522*b*.

In the example shown in FIG. 16, microwave energy interactive elements 1602*a*, 1602*b*, for example, susceptors, are supported on respective microwave energy transparent substrates 1612*a*, 1612*b*, for example, polymer film layers, to collectively define respective susceptor films or susceptor film layers 1614*a*, 1614*b*. Each susceptor film 1614*a*, 1614*b* is joined respectively to a microwave energy transparent, dimensionally stable support or support layer 1616*a*, 1616*b*, for example, paper. Support layer 1616*b* is joined to the fluted side of a single faced corrugated material 1618*a*, thereby defining a plurality of insulating voids or spaces 1620*a* between the flutes 1622*a* and the support layer 1616*b*, so that susceptor film 1614*b* and support 1616*b* are disposed between support layer 1616*a* and the flutes 1622*a* of the corrugated material 1618*a*. Susceptor 1602*a* circumscribes at least one, and in some examples, a plurality, of microwave energy transparent (i.e., inactive) areas 1604.

Still numerous other structures and constructs are encompassed by the disclosure. Any of such structures described herein or contemplated hereby may be formed from various materials, provided that the materials are substantially resistant to softening, scorching, combusting, or degrading at typical microwave oven heating temperatures, for example, at from about 250° F. to about 425° F. The particular materials used may include microwave energy interactive materials, for example, those used to form susceptors and other microwave energy interactive elements, and microwave energy transparent or inactive materials, for example, those used to form the base, substrate, and support layers.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable include, but are not limited to, oxides of aluminum, iron, and tin, used in conjunction with an electrically conductive material where needed. Another example of a metal oxide that may be suitable is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

While susceptors are described in detail herein in the illustrated exemplary constructs, the microwave energy interactive element alternatively or additionally may comprise a foil having a thickness sufficient to shield one or more selected portions of the food item from microwave energy. Such "shielding elements" may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one example, the shielding element may have a thickness of from about 0.0003 inches to about 0.03 inches. In another example, the shielding element may have a thickness of from about 0.00035 inches to about 0.020 inches, for example, about 0.016 inches.

As still another example, the microwave energy interactive element may comprise a segmented foil, such as, but not limited to, those described in U.S. Pat. Nos. 6,204,492, 6,433,322, 6,552,315, and 6,677,563. Although segmented foils are not continuous, appropriately spaced groupings of such segments may act as a shielding element. Such foils also may be used in combination with susceptor elements and, depending on the configuration and positioning of the segmented foil, the segmented foil may operate to direct microwave energy and promote heating rather than to shield microwave energy.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The breaks or apertures may extend through the entire structure, or only through one or more layers. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in one or more layers or materials used to form the construct (see, e.g., 518, 618, 818, 918; FIGS. 5, 6, 8, 9A, 9B), or may be a non-physical "aperture" (see, e.g., 1404, 1406, 1504, 1604; FIGS. 14A-16). A non-physical aperture is a microwave energy transparent area that allows microwave energy to pass through the structure without an actual void or hole cut through the structure. Such areas may be formed by simply not applying a microwave energy interactive material to the particular area, or by removing microwave energy interactive material in the particular area, and/or by chemically and/or mechanically deactivating the microwave energy interactive material in the particular area. While both physical and non-physical apertures allow the food item to be heated directly by the microwave energy, a physical aperture also provides a venting function to allow steam or other vapors to escape from the interior of the construct. It will be noted that where chemical deactivation is used, the metal in the deactivated area may be chemically altered, for example, oxidized, such that the non-physical aperture comprises a chemically altered, but microwave energy transparent, form of the metal.

As stated above, any of the microwave energy interactive elements may be supported on substrate comprising a polymer film or other suitable polymeric material. As used herein the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one particular example, the polymer film comprises polyethylene terephthalate. Examples of polyethylene terephthalate films that may be suitable for use as the substrate include, but are not limited to, MELINEX®, commercially available from DuPont Teijan Films (Hopewell, Va.), and SKYROL, commercially available from SKC, Inc. (Covington, Ga.). Polyethylene terephthalate films are used in commercially available susceptors, for example, the QWIK-WAVE Focus susceptor and the MICRORITE® susceptor, both available from Graphic Packaging International (Marietta, Ga.).

The thickness of the film generally may be from about 35 gauge to about 10 mil. In one example, the thickness of the film is from about 40 to about 80 gauge. In another example, the thickness of the film is from about 45 to about 50 gauge. In still another example, the thickness of the film is about 48 gauge.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683. Although particular examples of patterns of microwave energy interactive material are shown and described herein, it should be understood that other patterns of microwave energy interactive material are contemplated by the present disclosure.

Various corrugated materials may be used to form a microwave energy interactive structure. Corrugated materials have a longitudinal direction that runs along the length of the flutes, and a transverse direction that runs across the flutes. Corrugated materials may be relatively stiff when the material is flexed in the longitudinal direction, and relatively flexible when flexed in the transverse direction. Thus, it is contemplated that structural elements may be added to enhance the rigidity of the construct. Conversely, it also is contemplated that the construct may include elements that weaken the structure, for example, a score line, if needed or desired for a particular application. Single faced corrugated materials that may be suitable include, but are not limited to, flute sizes A, B (47 flutes/linear ft), E (90 flutes/linear ft), or any other size. Double faced corrugated materials that may be suitable include, but are not limited to, flute sizes B, C, E, and F.

Various materials may be used to form the support. For example, all or a portion of the support may be formed at least partially from a paper or paperboard material. In one example, the support is formed from paper generally having a basis weight of from about 15 to about 60 lbs/ream (lb/3000 sq. ft.), for example, from about 20 to about 40 lbs/ream. In another example, the paper has a basis weight of about 25 lbs/ream. In another example, the support is formed from paperboard having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

As another example, the support may be formed at least partially from a polymer or polymeric material. One polymer that may be suitable is polycarbonate. Other examples of other polymers that may be suitable include, but are not limited to, polyolefins, e.g. polyethylene, polypropylene, polybutylene, and copolymers thereof; polytetrafluoroethylene; polyesters, e.g. polyethylene terephthalate, e.g., coextruded polyethylene terephthalate; vinyl polymers, e.g., polyvinyl chloride, polyvinyl alcohol, ethylene vinyl alcohol, polyvinylidene chloride, polyvinyl acetate, polyvinyl chloride acetate, polyvinyl butyral; acrylic resins, e.g. polyacrylate, polymethylacrylate, and polymethylmethacrylate; polyamides, e.g., nylon 6,6; polystyrenes; polyurethanes; cellulosic resins, e.g., cellulosic nitrate, cellulosic acetate, cellulosic acetate butyrate, ethyl cellulose; copolymers of any of the above materials; or any blend or combination thereof.

The various constructs may be formed according to numerous processes known to those in the art, including using adhesive bonding, thermal bonding, ultrasonic bonding, mechanical stitching, or any other suitable process. Any of the various layers that may be used to form the constructs may be provided as a sheet of material, a roll of material, or a die cut material in the shape of the construct to be formed.

Optionally, one or more panels of the various constructs described herein or contemplated hereby may be coated with varnish, clay, or other materials, either alone or in combination. The coating may then be printed over with product advertising or other information or images. The constructs also may be coated to protect any information printed thereon. Furthermore, the constructs may be coated with, for example, a moisture barrier layer, on either or both sides.

Alternatively or additionally, any of the structures or constructs may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. US 2006/0049190 A1, published Mar. 9, 2006. Additionally, the structures or constructs may include graphics or indicia printed thereon.

Various aspects of the disclosure may be understood further from the following examples, which are not intended to be limiting in any manner.

EXAMPLES 1-7

Nestle panini sandwiches were heated to evaluate the performance of various constructs according to the disclosure. Each panini sandwich was placed on the construct being evaluated, placed into an 1100 W Panasonic microwave oven with a turntable, and heated on full power for about 8 minutes. The results are presented in Table 1, in which the various layers of constructs are described from the food-contacting side to microwave oven side. It will be understood that where a metallized film (i.e. susceptor film) forms an outermost layer of the construct, the metallized side of the susceptor film faces inwardly and the polymer film faces outwardly.

TABLE 1

Figure 17:
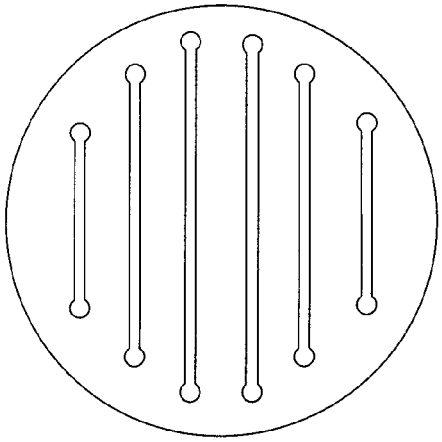
FIG. 17 is a schematic top plan view of a commercially available microwave energy interactive heating disk evaluated for comparative purposes.
Figure 18:
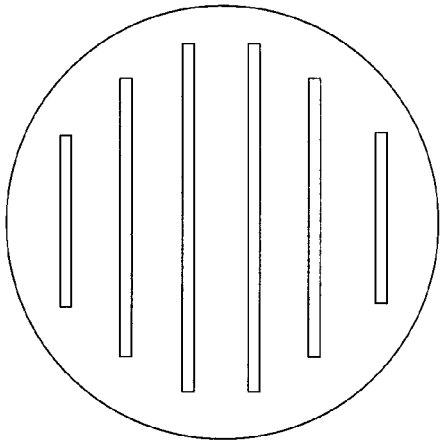
FIGS. 18-20 are schematic top plan views of other microwave energy interactive heating disks evaluated in accordance with the disclosure.

| Ex. | Construct | Results |
|---|---|---|
| 1 | Commercially available "control" structure with elongate apertures extending through the thickness of the structure, as illustrated schematically in FIG. 17:<br>48 gauge metallized polyethylene terephthalate film<br>paper support<br>48 gauge metallized polyethylene terephthalate film, with the metallized side of the film facing down<br>facing layer of a B flute corrugated material<br>flutes of the B flute corrugated material | Little browning or crisping of the bread |
| 2 | Experimental construct, as illustrated schematically in FIG. 10:<br>48 gauge metallized polyethylene terephthalate film<br>paper support<br>facing layer of a single faced B flute corrugated material<br>flutes of the corrugated material<br>48 gauge metallized polyethylene terephthalate film, corrugated | Improved browning and crisping of the bread relative to the structure of Ex. 1 |
| 3 | Experimental construct, as represented schematically in FIG. 9A, with strips of metallized film and support removed from the top side, as illustrated schematically in FIG. 18:<br>48 gauge metallized polyethylene terephthalate film<br>paper support<br>facing layer of a single faced B flute corrugated material<br>flutes of the corrugated material<br>48 gauge metallized polyethylene terephthalate film, corrugated | Improved browning and crisping of the bread relative to the structure of Ex. 1 |

TABLE 1-continued

Figure 19:
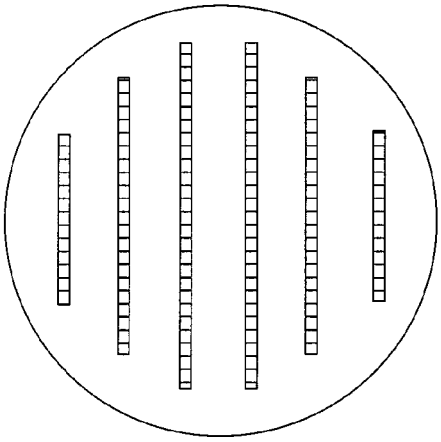
Figure 20:
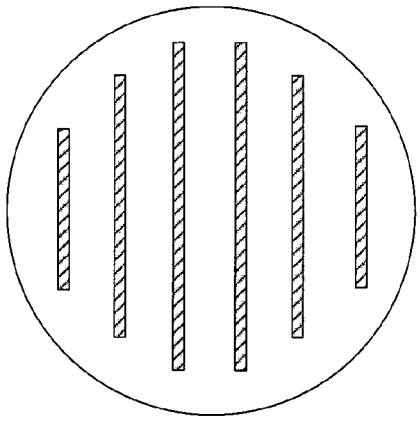

| Ex. | Construct | Results |
|---|---|---|
| 4 | Experimental construct, as represented schematically in FIG. 9B, with strips of metallized film and support removed from the bottom side, as illustrated schematically in FIG. 18:<br>48 gauge metallized polyethylene terephthalate film<br>fluted side of a single faced B flute corrugated material<br>facing layer of the corrugated material<br>paper support<br>48 gauge metallized polyethylene terephthalate film | Improved browning and/or crisping of the bread relative to the structure of Ex. 1 |
| 5 | Experimental construct, as represented schematically in FIG. 8, with slits extending through metallized film and support on top side of construct (slits transverse to the corrugated metallized film/paper layer, as illustrated schematically in FIG. 19):<br>48 gauge metallized polyethylene terephthalate film<br>overlying paper support<br>48 gauge metallized polyethylene terephthalate film, corrugated<br>flutes of a single faced B flute corrugated material<br>facing layer of the corrugated material | Improved browning and/or crisping of the bread relative to the structure of Ex. 1 |
| 6 | Experimental construct, as represented schematically in FIG. 5, with slits extending through metallized film and support (slits oblique to the length of the flutes, as illustrated schematically in FIG. 20):<br>48 gauge metallized polyethylene terephthalate film<br>overlying paper support<br>flutes of a single faced B flute corrugated material<br>facing layer of the corrugated material<br>paper support<br>48 gauge metallized polyethylene terephthalate film | Improved browning and/or crisping of the bread relative to the structure of Ex. 1 |
| 7 | Experimental construct, as represented schematically in FIG. 6:<br>48 gauge metallized polyethylene terephthalate film<br>overlying paper support with slits extending through metallized film and support<br>facing layer of a of a single faced B flute corrugated material<br>flutes of the corrugated material<br>48 gauge metallized polyethylene terephthalate film<br>paper support | Improved browning and/or crisping of the bread relative to the structure of Ex. 1 |

EXAMPLES 8-11

Commercially available frozen 9 inch diameter deluxe Tombstone pizzas were heated to evaluate the performance of various constructs according to the disclosure. Each pizza was placed on the construct being evaluated, placed into an 1100 W Panasonic microwave oven with a turntable, and heated on full power for about 8 minutes. The results are presented in Table 2.

TABLE 2

| Ex. | Construct | Results |
|---|---|---|
| 8 | Double susceptor "control" structure without corrugated base:<br>48 gauge metallized polyethylene terephthalate film<br>paperboard support<br>48 gauge metallized polyethylene terephthalate film<br>paperboard support | Top of pizza overcooked, edges of bottom crust browned, but other areas soggy and undercooked |
| 9 | Single layer susceptor "control" structure with corrugated base:<br>48 gauge metallized polyethylene terephthalate film<br>paper support<br>facing layer of B flute bleached corrugated material<br>flutes of the corrugated material | Top of pizza overcooked, bottom of crust soggy and not browned |
| 10 | Experimental construct, as represented schematically in FIG. 4:<br>48 gauge metallized polyethylene terephthalate film<br>paper support<br>facing layer of B flute bleached corrugated material<br>flutes of the corrugated material<br>48 gauge metallized polyethylene terephthalate film<br>paper support | Top of pizza in better condition, particularly along edge of pizza, excellent browning and crisping of bottom of crust, |

TABLE 2-continued

| Ex. | Construct | Results |
|---|---|---|
| 11 | Experimental triple susceptor construct, as represented schematically in FIG. 7:<br>48 gauge metallized polyethylene terephthalate film paper support<br>48 gauge metallized polyethylene terephthalate film, corrugated<br>B flute bleached corrugated material<br>48 gauge metallized polyethylene terephthalate film paper support | Top of pizza heated evenly, pizza crust heated, browned, and crisped evenly |

Notably, the construct of Example 10 became significantly hotter beneath the pizza as compared with the construct of Example 8, yet the outer edges outside of pizza did not scorch. Thus, the construct of Example 10 exhibited greater heating power, but more gentle heating than the construct of Example 8. The construct of Example 11 became the hottest when exposed to microwave energy. Thus, more susceptor layers may be used where it is desirable to reach higher temperatures to brown and/or crisp the food item.

EXAMPLES 12-13

Commercially available frozen 10 inch diameter deluxe Tombstone pizzas were heated to evaluate the performance of various constructs according to the disclosure. Each pizza was placed on the construct being evaluated, placed into an 1100 W Panasonic microwave oven with a turntable, and heated on full power for about 8 minutes. The results are presented in Table 3.

TABLE 3

| Ex. | Construct | Results |
|---|---|---|
| 12 | Experimental construct, as represented schematically in FIG. 15, with the arrangement of microwave energy transparent areas shown in FIG. 14A, with the microwave transparent areas 1404 having a diameter of about 0.5 in | Good browning and crisping |
| 13 | Experimental construct, as represented schematically in FIG. 16, with the arrangement of microwave energy transparent areas shown in FIG. 14A, with the microwave transparent areas 1404 having a diameter of about 0.5 in | Good browning and crisping |

Although certain embodiments have been described with a certain degree of particularity, those skilled in the art could make numerous alterations to the disclosed embodiments without departing from the spirit or scope of the invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the invention. It is intended that all matter contained in the above description or shown in the accompanying drawings shall be interpreted as illustrative only and not limiting. Changes in detail or structure may be made without departing from the spirit of the invention. The detailed description set forth herein is not intended nor is to be construed to limit the invention or otherwise to exclude any such other embodiments, adaptations, variations, modifications, and equivalent arrangements of the invention.

Accordingly, it will be readily understood by those persons skilled in the art that, in view of the above detailed description of the invention, the invention is susceptible of broad utility and application. Many adaptations of the invention other than those herein described, as well as many variations, modifications, and equivalent arrangements will be apparent from or reasonably suggested by the invention and the above detailed description thereof, without departing from the substance or scope of the invention.

While the invention is described herein in detail in relation to specific aspects or embodiments, it is to be understood that this detailed description is only illustrative and exemplary of the invention and is made merely for purposes of providing a full and enabling disclosure. The detailed description set forth herein is not intended nor is to be construed to limit the invention or otherwise to exclude any such other embodiments, adaptations, variations, modifications, and equivalent arrangements of the invention.

What is claimed is:

1. A thermally insulated susceptor structure comprising:

a dimensionally stable base having a first side and a second side opposite the first side, the base including a plurality of corrugations;

a first susceptor overlying the first side of the base in a substantially planar configuration, so that a plurality of insulating voids are positioned between the first susceptor and the plurality of corrugations; and a second susceptor overlying the first susceptor in a substantially planar configuration, wherein the first susceptor and the second susceptor each comprise microwave energy interactive material, and at least one of the first susceptor and the second susceptor circumscribes at least one microwave energy transparent area, wherein the at least one microwave energy transparent area comprises the microwave energy interactive material in a deactivated condition, wherein the at least one microwave energy transparent area comprises a first plurality of microwave energy transparent areas arranged around a center of the construct, and a second plurality of microwave energy transparent areas arranged around the first plurality of microwave energy transparent areas, wherein the first plurality of microwave energy transparent areas decrease in number from the center of the construct towards the second plurality of microwave energy transparent areas.

2. The structure of claim 1, wherein at least one of the first susceptor and the second susceptor is supported on a respective polymer film layer.

3. The structure of claim 2, wherein at least one of the first susceptor and the second susceptor is joined to a respective support layer on a side of the susceptor distal from the respective polymer film layer.

4. The structure of claim 1, further comprising a paper layer joined to the second side of the base in a substantially planar configuration across the corrugations.

5. The structure of claim 1, wherein the first susceptor is positioned between a first paper layer and a first polymer film layer, wherein the first paper layer extends across the corrugations.

6. The structure of claim 5, wherein the insulating voids are defined between the first paper layer and the plurality of corrugations.

7. The structure of claim 5, wherein the second susceptor is positioned between a second paper layer and a second polymer film layer, wherein the second paper layer is joined to the first polymer film layer.

8. The structure of claim 7, wherein the second polymer film layer defines an outermost surface of the construct.

9. The structure of claim 1, wherein at least some of the first plurality of microwave energy transparent areas are substantially circular in shape.

10. The structure of claim 1, wherein at least some of the second plurality of microwave energy transparent areas are substantially square in shape.

11. The structure of claim 10, wherein the second plurality of microwave energy transparent areas are arranged in columns and rows, so that the second susceptor is substantially grid shaped.

12. A microwave heating construct comprising:

a corrugated base having first and second opposite sides;

a first susceptor film extending across the first side of the corrugated base in a substantially planar configuration; and a second susceptor film extending across the first side of the corrugated base in a substantially planar configuration, such that the first susceptor film is positioned between the corrugated base and the second susceptor film, wherein the first susceptor film and the second susceptor film each comprise microwave energy interactive material supported on a respective polymer film, and the microwave energy interactive material of at least one of the first susceptor film and the second susceptor film includes a plurality of microwave energy transparent areas, wherein at least some of the plurality of microwave energy transparent areas comprise the microwave energy interactive material in a deactivated condition, wherein the plurality of microwave energy transparent areas are configured as a first plurality of microwave energy transparent areas positioned to define a central region of the construct, wherein at least some of the first plurality of microwave energy transparent areas are substantially circular in shape, and a second plurality of microwave energy transparent areas positioned to define a peripheral region of the construct, wherein the first plurality of microwave energy transparent areas decrease in number from a center of the construct towards the second plurality of microwave energy transparent areas.

13. The construct of claim 12, further comprising a first paper layer positioned between the first side of the corrugated base and the first susceptor film, so that a plurality of insulating voids are defined between the first paper layer and the first side of the corrugated base, and a second paper layer positioned between the first susceptor film and the second susceptor film.

14. The structure of claim 12, wherein at least some of the second plurality of microwave energy transparent areas are substantially square in shape, so that the second layer of microwave energy interactive material is substantially grid shaped.

15. A thermally insulated susceptor structure comprising:

a dimensionally stable base having a first side and a second side opposite the first side, the base including a plurality of corrugations;

a first susceptor overlying the first side of the base in a substantially planar configuration, so that a plurality of insulating voids are positioned between the first susceptor and the plurality of corrugations; and a second susceptor overlying the first susceptor in a substantially planar configuration, wherein at least one of the first susceptor and the second susceptor circumscribes at least one microwave energy transparent area, wherein the at least one microwave energy transparent area comprises a first plurality of microwave energy transparent areas arranged around a center of the construct, and a second plurality of microwave energy transparent areas arranged around the first plurality of microwave energy transparent areas, wherein the first plurality of microwave energy transparent areas decrease in number from the center of the construct towards the second plurality of microwave energy transparent areas.

16. A thermally insulated susceptor structure comprising:

a dimensionally stable base having a first side and a second side opposite the first side, the base including a plurality of corrugations;

a first susceptor overlying the first side of the base in a substantially planar configuration, so that a plurality of insulating voids are positioned between the first susceptor and the plurality of corrugations; and a second susceptor overlying the first susceptor in a substantially planar configuration, wherein at least one of the first susceptor and the second susceptor circumscribes at least one microwave energy transparent area, wherein the at least one microwave energy transparent area comprises a first plurality of microwave energy transparent areas arranged around a center of the construct, and a second plurality of microwave energy transparent areas arranged around the first plurality of microwave energy transparent areas, wherein at least some of the second plurality of microwave energy transparent areas are substantially square in shape.

17. The structure of claim 16, wherein the second plurality of microwave energy transparent areas are arranged in columns and rows, so that the second susceptor is substantially grid shaped.

18. A microwave heating construct comprising:

a corrugated base having first and second opposite sides;

a first susceptor film extending across the first side of the corrugated base in a substantially planar configuration; and a second susceptor film extending across the first side of the corrugated base in a substantially planar configuration, such that the first susceptor film is positioned between the corrugated base and the second susceptor film, wherein the first susceptor film comprises a first layer of microwave energy interactive material on a first polymer film, and the second susceptor film comprises a second layer of microwave energy interactive material on a second polymer film, wherein at least one of the first layer of microwave energy interactive material and the second layer of microwave energy interactive material includes a plurality of microwave energy transparent areas, wherein the plurality of microwave energy transparent areas is configured as a first plurality of microwave energy transparent areas positioned to define a central region of the construct, at least some of the first plurality of microwave energy transparent areas being substantially circular in shape, and a second plurality of microwave energy transparent areas positioned to define a peripheral region of the construct, wherein the first plurality of microwave energy transparent areas decrease in number from a center of the construct towards the second plurality of microwave energy transparent areas.

19. A microwave heating construct comprising:

a corrugated base having first and second opposite sides;

a first susceptor film extending across the first side of the corrugated base in a substantially planar configuration; and a second susceptor film extending across the first side of the corrugated base in a substantially planar configuration, such that the first susceptor film is positioned between the corrugated base and the second susceptor film, wherein the first susceptor film comprises a first layer of microwave energy interactive material on a first polymer film, and the second susceptor film comprises a second layer of microwave energy interactive material on a second polymer film, wherein at least one of the first layer of microwave energy interactive material and the second layer of microwave energy interactive material includes a plurality of microwave energy transparent areas, wherein the plurality of microwave energy transparent areas is configured as a first plurality of microwave energy transparent areas positioned to define a central region of the construct, and a second plurality of microwave energy transparent areas positioned to define a peripheral region of the construct, wherein at least some of the second plurality of microwave energy transparent areas are substantially square in shape, so that the second layer of microwave energy interactive material is substantially grid shaped.

20. A thermally insulated susceptor structure comprising:

a dimensionally stable base having a first side and a second side opposite the first side, the base including a plurality of corrugations;

a first susceptor overlying the first side of the base in a substantially planar configuration, so that a plurality of insulating voids are positioned between the first susceptor and the plurality of corrugations; and a second susceptor overlying the first susceptor in a substantially planar configuration, wherein the first susceptor and the second susceptor each comprise microwave energy interactive material, and at least one of the first susceptor and the second susceptor circumscribes at least one microwave energy transparent area, wherein the at least one microwave energy transparent area comprises the microwave energy interactive material in a deactivated condition, wherein the at least one microwave energy transparent area comprises a first plurality of microwave energy transparent areas arranged around a center of the construct, and a second plurality of microwave energy transparent areas arranged around the first plurality of microwave energy transparent areas, wherein at least some of the second plurality of microwave energy transparent areas are substantially square in shape.

21. The structure of claim 20, wherein at least one of the first susceptor and the second susceptor is supported on a respective polymer film layer.

22. The structure of claim 21, wherein at least one of the first susceptor and the second susceptor is joined to a respective support layer on a side of the susceptor distal from the respective polymer film layer.

23. The structure of claim 20, further comprising a paper layer joined to the second side of the base in a substantially planar configuration across the corrugations.

24. The structure of claim 20, wherein the first susceptor is positioned between a first paper layer and a first polymer film layer, wherein the first paper layer extends across the corrugations.

25. The structure of claim 24, wherein the insulating voids are defined between the first paper layer and the plurality of corrugations.

26. The structure of claim 24, wherein the second susceptor is positioned between a second paper layer and a second polymer film layer, wherein the second paper layer is joined to the first polymer film layer.

27. The structure of claim 26, wherein the second polymer film layer defines an outermost surface of the construct.

28. The structure of claim 20, wherein at least some of the first plurality of microwave energy transparent areas are substantially circular in shape.

29. The structure of claim 20, wherein the first plurality of microwave energy transparent areas decrease in number from the center of the construct towards the second plurality of microwave energy transparent areas.

30. The structure of claim 20, wherein the second plurality of microwave energy transparent areas are arranged in columns and rows, so that the second susceptor is substantially grid shaped.

31. A microwave heating construct comprising:

a corrugated base having first and second opposite sides;

a first susceptor film extending across the first side of the corrugated base in a substantially planar configuration; and a second susceptor film extending across the first side of the corrugated base in a substantially planar configuration, such that the first susceptor film is positioned between the corrugated base and the second susceptor film, wherein the first susceptor film and the second susceptor film each comprise microwave energy interactive material supported on a respective polymer film, and the microwave energy interactive material of at least one of the first susceptor film and the second susceptor film includes a plurality of microwave energy transparent areas, wherein at least some of the plurality of microwave energy transparent areas comprise the microwave energy interactive material in a deactivated condition, wherein the plurality of microwave energy transparent areas are configured as a first plurality of microwave energy transparent areas positioned to define a central region of the construct, and a second plurality of microwave energy transparent areas positioned to define a peripheral region of the construct, wherein at least some of the second plurality of microwave energy transparent areas are substantially square in shape, so that the second layer of microwave energy interactive material is substantially grid shaped.

32. The construct of claim 31, further comprising a first paper layer positioned between the first side of the corrugated base and the first susceptor film, so that a plurality of insulating voids are defined between the first paper layer and the first side of the corrugated base, and a second paper layer positioned between the first susceptor film and the second susceptor film.

33. The structure of claim 31, wherein at least some of the first plurality of microwave energy transparent areas are substantially circular in shape.

34. The structure of claim 33, wherein the first plurality of microwave energy transparent areas decrease in number from a center of the construct towards the second plurality of microwave energy transparent areas.

* * * * *